United States Patent [19]

Smith

[11] Patent Number: 4,752,103

[45] Date of Patent: Jun. 21, 1988

[54] DEVICE FOR REMOVING ASBESTOS AND THE LIKE

[75] Inventor: Jeffrey D. Smith, Allison Park, Pa.

[73] Assignee: American Industrial Contracting, Inc., Sewickley, Pa.

[21] Appl. No.: 46,272

[22] Filed: May 5, 1987

[51] Int. Cl.[4] ..... A47L 13/08

[52] U.S. Cl. ..... 299/64; 15/50 C; 51/180

[58] Field of Search ..... 299/64, 68, 87; 15/49 C, 50 C; 51/180, 176, 170 PT; 182/129, 148; 241/98

[56] References Cited

U.S. PATENT DOCUMENTS

| | | | |
|---|---|---|---|
| 459,486 | 9/1891 | Dunne | 51/180 |
| 1,134,925 | 4/1915 | Soderlund | 15/50 C |
| 1,561,250 | 11/1925 | Kunze | 51/180 X |
| 1,919,854 | 7/1933 | Masseau | 15/50 C |
| 3,288,536 | 11/1966 | Galis et al. | 299/64 |
| 3,422,922 | 1/1969 | Aiken | 182/148 |
| 3,452,461 | 7/1969 | Hanson | 37/110 |
| 4,274,676 | 6/1981 | Chapel | 299/64 |
| 4,438,977 | 3/1984 | Chapel | 299/64 |
| 4,589,701 | 5/1986 | Beckmann et al. | 299/72 |

*Primary Examiner*—Stephen J. Novosad
*Assistant Examiner*—David J. Bagnell
*Attorney, Agent, or Firm*—Parmelee, Miller, Welsh & Kratz

[57] ABSTRACT

A device for safely and economically removing asbestos and like materials from ceiling surfaces comprises an extensible hoist which is motorized for travel along a floor beneath the ceiling to be stripped. The hoist includes an open-topped hopper which is adapted to be moved to a position adjacent the ceiling. A pair of motor driven auger cutters are positioned on the top of the hopper adapted to cuttingly engage the asbestos and deposit it within the hopper. The hopper has a discharge opening at the bottom which is connected to a closed collection drum via a conduit mounted beneath the hopper for storing the stripped asbestos material therein. Spring biasing means are associated with a hopper mounting frame to provide constant contact between the augers and the ceiling.

10 Claims, 2 Drawing Sheets

DEVICE FOR REMOVING ASBESTOS AND THE LIKE

BACKGROUND OF THE INVENTION

The present invention relates generally to devices for cutting and removing materials from a surface. More particularly, the invention is directed to apparatus for safely, efficiently and economically removing asbestos and like materials from ceilings.

In recent years the health hazards of asbestos have become widely recognized, particularly identifying the material as a carcinogen. Accordingly, steps have been taken to halt its further use in environments where persons may be exposed to it. In those cases where asbestos is already in place as an insulation material, such as in schools and other public buildings, there has been an accelerated movement to have it removed. The removal and disposal of asbestos material from buildings has been generally tedious and expensive while being a constant health hazard to workmen and to others close to the work area. Heretofore, much of the asbestos removal work has involved hand labor using conventional scraping or abrading hand or power driven tools. Such conventional tools generate dangerous amounts of asbestos laden dust adjacent the work surface. This generation of asbestos dust commonly necessitates the use of plastic sheet material to form barriers to confine the dust within the space or within the room where the stripping work is being conducted. It can be readily appreciated that such hand work is slow, particularly, in hard to reach areas, such as high ceilings which also require the use of ladders and/or scaffolds. It is further seen that the technique of confining or sealing-off the work area, actually increases the health risks of the confined workers due to the dust concentration effects thereof.

In addition to the above generally used isolation technique for removing asbestos, it has been proposed in U.S. Pat. Nos. 4,274,676 and 4,438,977 to employ a liquid spray to first wet the asbestos material and to remove the wetted asbestos from walls by a cutter head and scraper assembly. The rather cumbersome apparatus which is required to apply, collect and recirculate liquid, and the attendant problems in operating a wet system, are apparent in the proposed apparatus of the cited patents. To my knowledge, such apparatus has not been widely used, if at all.

SUMMARY OF THE INVENTION

The present invention solves many of the problems heretofore encountered in removing asbestos from surfaces, particularly from difficult to reach surfaces, such as high ceilings. The present invention provides a device for removing asbestos in a fast, efficient and economical manner while providing a nearly pollution free environment for the operator and for those in adjacent work areas. The present invention further provides a device which is particularly suited for removing asbestos from ceilings which have an irregular surface and/or variable height.

Briefly stated, the present invention provides an apparatus for removing asbestos and like hard materials, from a surface, such as a ceiling. The apparatus comprises a wheeled, extensible hoist means which includes a drive motor for motivating the hoist means along a floor beneath the asbestos ceiling surface to be stripped. An open-topped hopper is mounted on an upper portion of the hoist means by way of a spring biased support frame which is adapted to maintain a constant spacing between the ceiling surface and the open top of the hopper even though there may be local variations in the height of the ceiling surface from the floor. A pair of cutter elements, preferably in the form of spiral auger cutters are rotatably mounted at the top of the hopper, spanning the width thereof. The longitudinal axes of the augers are parallel to the ceiling and the cutting surfaces protrude above the upper hopper edge to engage the ceiling surface when the hoist means is extended to an operable position. A motor is provided to rotate the augers whereby the flights of said augers are adapted to penetrate into the asbestos material and disengage it, in a planing fashion, from the building sub-surface. A roller brush is mounted across the top of the hopper rearwardly from the auger set to provide a final removal step for any loosened asbestos particules left behind by the augers. The hopper has downwardly sloping sidewalls and an open discharge port adapted to receive the stripped asbestos material therein. A collection bin, which conveniently may be in the form of a conventional 50 gallon steel drum, is positioned on a bottom frame of the hoist means. A flexible conduit is fitted between the discharge port of the hopper and an air tight lid positioned on the steel drum for conveying the stripped asbestos material therebetween. After a given time of operation, the steel drum becomes filled with asbestos material. The filled collection drum is simply removed from hoist means and replaced with an empty drum for continued operation.

BRIEF DESRIPTION OF THE DRAWINGS

These, as well as other advantages and features of the present invention will become apparent when reference is made to the following detailed description, taken with the appended drawings, in which.

DETAILED DESCRIPTION OF THE INVENTION

Figure 2:
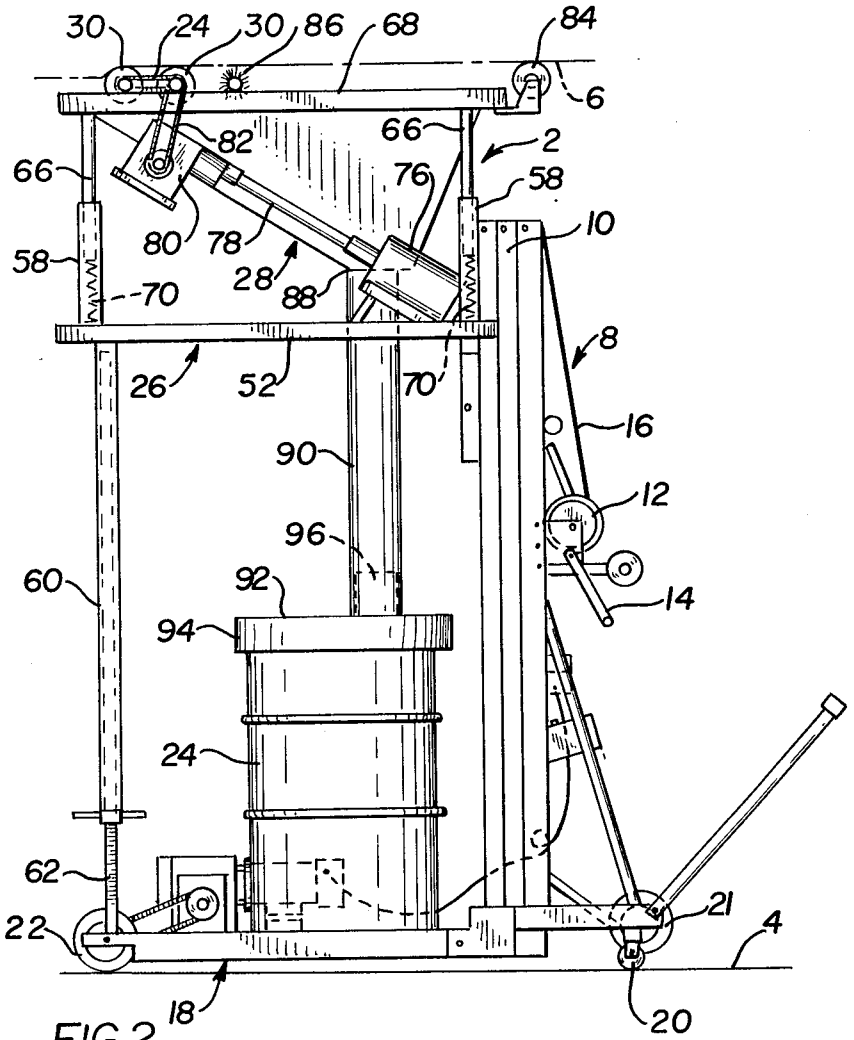
FIG. 2 is a side elevational view of the device of FIG. 1 taken from the opposite side thereof.

Referring now to the drawings, the asbestos removal device of the present invention is depicted generally by the numeral 2 and is adapted to travel along a horizontal floor surface 4 beneath a ceiling surface 6. The device 2 of the invention includes an extensible hoist or lift means, generally designated 8. The extensible lift 8 may be a conventional, commercially available unit, such as that sold under the trademark "GENIE SUPERLIFT", which is suitably modified as explained hereinafter. The lift means 8 includes a plurality of telescoping sections 10 which are raised or lowered to vary the overall height by way of a winch 12 turned by a crank 14 which regulates the movement of a rope or cable 16 through a series of pulleys in a known manner. In a fully extended position, the extensible hoist 8 is able to reach a height of about eighteen feet. The lower portion of the hoist means 8 includes a bottom frame 18 which has a pair of rear support wheels 20 and a pair of front support wheels 22 mounted for rotation thereon. Rear support wheels 20 are independently pivotally mounted to permit 360° swiveling movement of each wheel about a vertical axis to permit the device 2 to be turned at the end of a stripping run and aligned for the next adjacent run, as will be explained in greater detail hereinafter. A pair of larger diameter rear transport wheels 21 are also provided on the lower frame 18. Wheels 21 are normally spaced from the floor surface 4 when the device 2 is in the upright operating position shown in the drawings. Transport wheels 21 are adapted to touch the surface 4 and rotatably support the weight of the device 2 when the apparatus is tilted toward the rear and, thus, provide a convenient set of towing wheels to permit the device to be moved between job sites. For this purpose, a conventional towing hitch (not shown) may be fitted adjacent the upper segment 10 of the frame so that towing behind a vehicle is made possible.

The extensible hoist means 8 also has a steering handle 32 which is pivotally attached at end 34 to the lower frame 18. In operation, the device 2 is guided by an operator who grasps the handle member 32 at the crossbar portion 36 thereof and manually maneuvers the frame through the pivotal movement of rear wheels 20.

Figure 1:
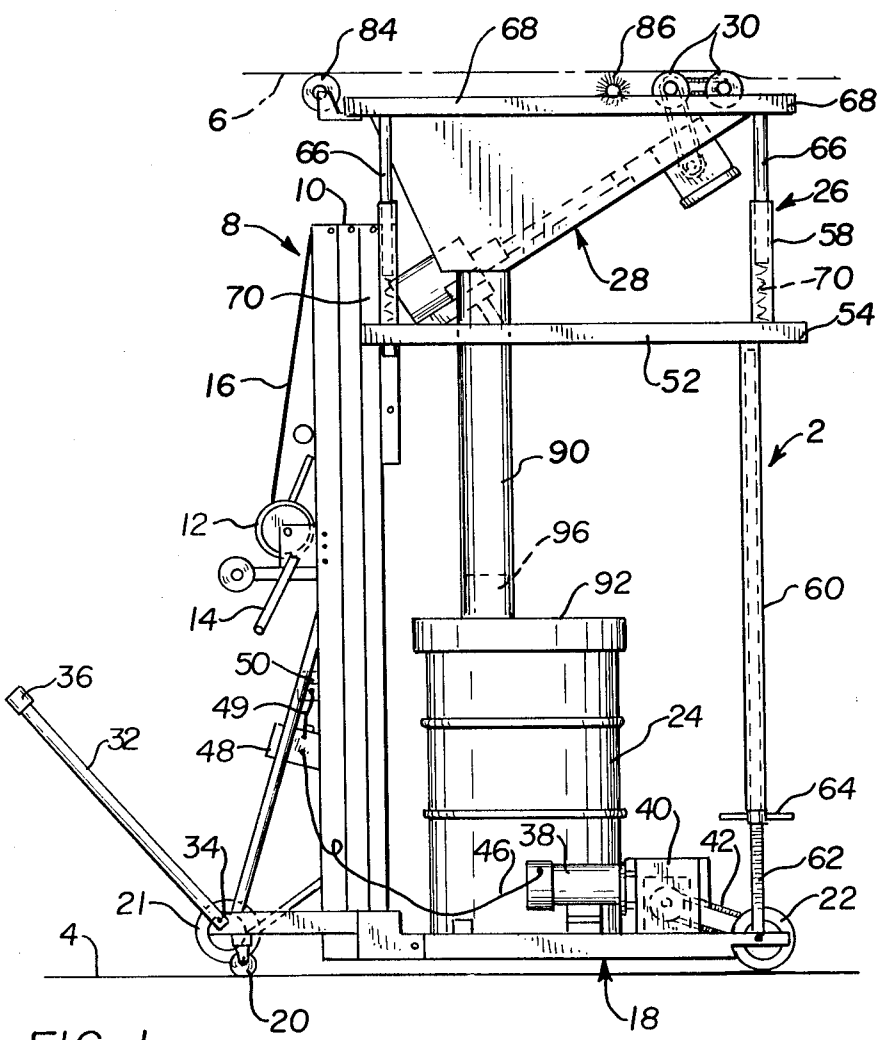
FIG. 1 is a side elevational view of a device for removing asbestos from ceilings constructed in accordance with the present invention.
Figure 3:
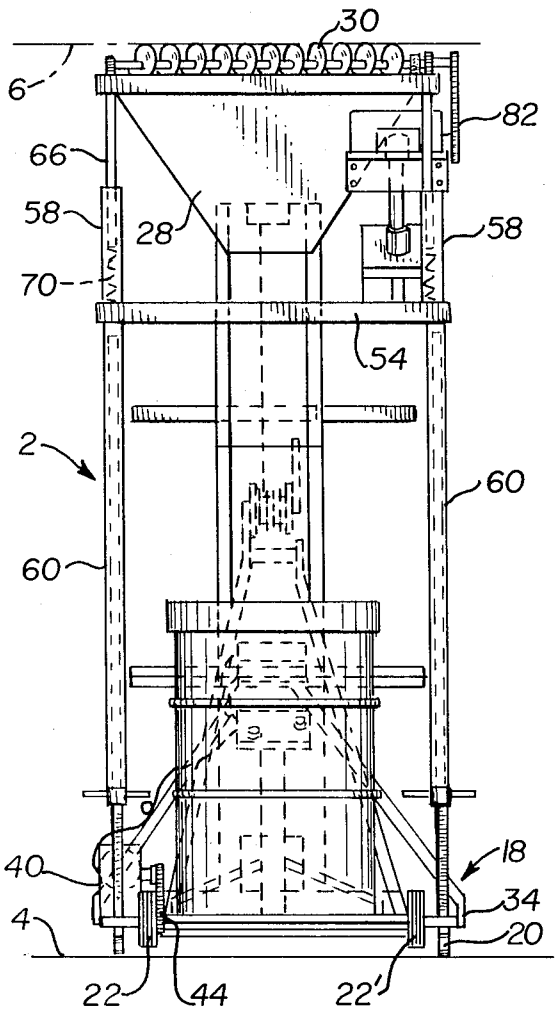
FIG. 3 is a front elevational view of the device of FIG. 1.

An electric motor 38 is mounted on the frame 18 for driving one of the front wheels 22 through a suitable gear reducer 40, drive chain 42 and sprocket 44, FIGS. 1 and 3. In a preferred embodiment shown in FIG. 3, front wheel 22 is driven by sprocket 44 while front wheel 22' is not fixed with respect to the sprocket 44 and, hence, is permitted to free wheel.

An electrical supply line 46 runs between the motor 38 and a control box 48. A supply line 49 electrically connects the control box 48 with a fused junction box 50, which, in turn, is adapted to be connected to a suitable external supply of electricity, such as conventional 110 volts. The control box 50 includes a rheostat device which permits the operator to adjust the speed of the motor 38 and, thus, the rate of travel of the device 2 along the floor 4 can be controlled to suit the job conditions.

Figure 4:
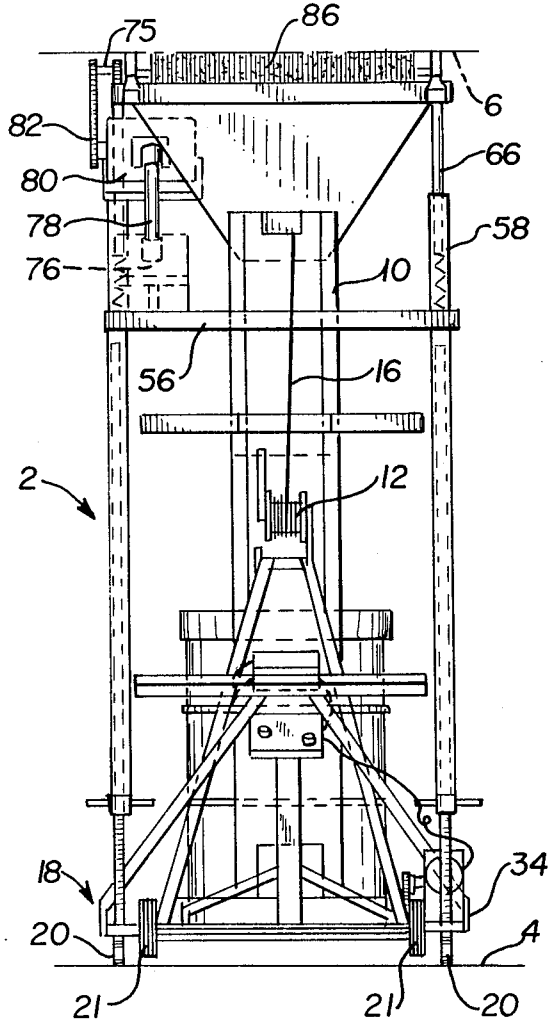
FIG. 4 is a rear elevational view of the device of FIG. 1.

The upper frame 26 of the device 2 comprises a pair of spaced-apart side channel elements 52, FIGS. 1 and 2, interconnected at the front by a channel member 54, FIG. 3, and at the rear by a similar channel member 56, FIG. 4, which is attached to the telescoping segment 10. A pair of vertical tubes 60 are attached to the front of the frame 26 at the junctions of the channels 52 and 54 and extend downwardly to receive a threaded rod 62 therein. A jacking wing nut 64, FIG. 1, is also employed on each so that the tubes 60 can be vertically adjusted so as to support a portion of the weight of the upper frame 26.

Four hollow, tubular members 58 are attached to the frame elements 52, 54, 56 near each of the corners thereof such that the tube axes are vertically aligned relative to a horizontal plane defined by the frame elements. The previously mentioned hopper 28 has four spaced-apart guide rods 66 downwardly depending from its peripheral edge 68. Each of the guide rods are slidably received within a respective tubular member 58. Each of the tubular members 58 also have a spring element 70 therewithin which engage the ends of the guide rods 66 so as to provide a biasing action between the hopper 28 and the ceiling 6 to accommodate variations in height between the floor and ceiling as the device travels along a stripping run. Of course other arrangements of a spring loaded hopper frame can be made, such as, for example, the tubular members 58 could be dispensed with, and coil springs could be placed around each of the rods 66. In this modified version (not shown), the rods 66 would extend through the framing elements 52 and 54 to provide for biasing movement therebetween.

The peripheral edge of the hopper 28 carries four bearing mounts 72 for rotatably receiving the shafts of auger cutters 30 therein. Each of the auger shafts carries a sprocket which is connected by a drive chain 74. An extended shaft and sprocket 75 is attached to one of the shafts of the augers 30 for driving the chain 74 and the augers. An electric motor 76 is mounted on the upper frame 26 and turns a drive shaft 78 which is fitted with a pair of universal joints to permit the required degree of flexibility to the drive system. The shaft 78 is connected to a reducer gear box 80 which, in turn, carries a sprocket which turns a drive chain 82 connected to the extended shaft and sprocket 75 of the auger drive. Hence, when the motor 76 is energized through suitable controls also associated with the control box 48, the cutting augers are rotated.

Figure 5:
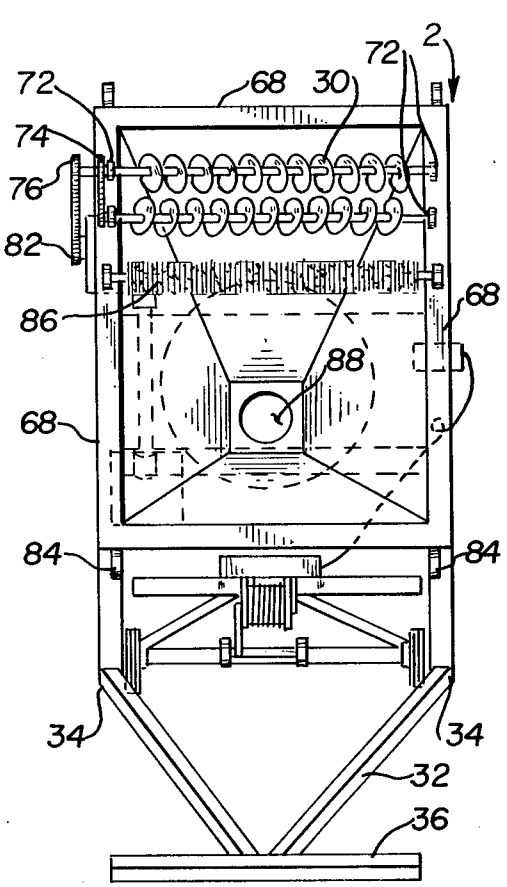
FIG. 5 is a top plan view of the device of FIG. 1.

The pair of cutting augers 30 lie side-by-side in spaced-apart fashion as seen in FIG. 5. Each auger comprises a longitudinally extending shaft which is parallel to the plane of the ceiling 6 and carries a helically wound cutting surface thereon. The helices described by the augers are oppositely would with respect to one another, in that, for example, a first auger 30 may have a right hand wound helix surface while an adjacent, second auger 30 has an opposite, left hand would helix cutting surface thereon. In this manner, the cutting surfaces overlap respective cutting paths to insure that all portions of the work surface 6 are engaged by the augers 30 as the device 2 traverses the ceiling. The augers 30 are forcibly urged into contact with the layer of asbestos, or other material to be removed from the surface 6, through the biasing force generated by the spring elements 70. The rotating augers cut into the asbestos layer and continuously plane or mill the unwanted material from the ceiling surface 6.

The asbestos pieces so removed fall by gravity into the interior of the hopper 28 and pass through a hopper outlet 88 to a conduit 90 to be deposited in the closed drum 24 carried by the lower frame 18. The container 24 which preferably is a conventional 50 gallon capacity steel drum, is fitted with a tight fitting lid 92 having a downwardly extending skirt 94 to prevent the escape of asbestos dust from the drum. The conduit 90 is preferably a flexible tube of a plastic or fabric material to permit vertical adjustment of the hoist to accommodate various spacings between the lid 94 and the bottom of the hopper 28. The conduit 90 is fitted around the outside of an upwardly extending, cylindrical skirt 96 formed on the upper surface of the drum lid 94 and secured thereto by conventional means, such as an adjustable ring clamp (not shown).

A stiff bristle, rotatable roller brush 86 is mounted rearwardly of the augers 30 and extends across the open top of the hopper 28 and parallel to the ceiling to provide a final clean-up of any still adhered particles of asbestos or the like. The brush 86 may be powered (not shown) to rotate in either direction or it may be left to free wheel, depending upon the surface conditions encountered. Of course, more than one clean-up brush 86 may be employed, if desired.

A pair of leveler wheels 84 are also preferably provided at the rear of the upper edge 68 of the hopper 28, as seen in FIGS. 1, 2 and 5, to maintain a substantially parallel relationship between the top of the hopper and the ceiling surface 6. In this manner the upper frame 26 is free to float on the spring-loaded guide rods 66 when the augers 30 and wheels 84 engage the ceiling at the front and rear edges, respectively, of the hopper. Otherwise, without the leveler wheels 84, there is a tendency for the rear of the hopper to spring upwardly toward the ceiling which causes an undesirable binding action between the guide rods 66 and the tubular members 58, thus, reducing the desired free-floating movement of the hopper to compensate for variations in ceiling height.

In operation, the apparatus 2 is wheeled into position beneath a ceiling to be stripped. The winch 12 is turned by the handle 14 to cause the rope cable 16 to raise the telescoping segments 10 of the hoist 8 and the attached hopper assembly 26 upwardly to the ceiling 6. The hopper 26 is raised until the augers 30 and rollers 84 engage the ceiling. The motor 76 is energized to permit the augers to rotatably dig into the asbestos surface. The height of the hoist 8 is the raised such that the springs 70 are compressed so that contact between the augers 30 and the ceiling subsurface is maintained even if the ceiling height varies upwards of an inch or more. The transport motor 38 is then energized to cause movement of the drive chain 42 and the front wheel 22 which then moves the entire apparatus 2 along the floor 4 beneath the ceiling surface 6 being stripped. The operator guides the device by grasping the handle crossbar 36 and he may select a convenient walking rate by adjusting the rheostat on the control box 48 which, in turn, controls the speed of the motor 38. After a stripping run is completed, the operator turns the apparatus by pivoting the wheeled device about the rear wheels 20 and begins another run. Work continues in a similar manner until the collection drum 24 is filled with stripped ceiling material. A transparent sight glass (not shown) may be provided on the top of lid 92 to enable the operator to visually determine when the drum 24 needs to be replaced with an empty drum. The full drum is removed from the lower frame 18, properly sealed and disposed of in an approved manner. An empty drum is then moved into place on the frame 18 and the lid 92 with attached conduit 90 is fitted thereon for further operation.

The device 2 of the present invention is quite efficient in removing asbestos and like hardened materials from a surface due to the planing or milling action of the auger cutters 30. In addition, due to the close proximity of the hopper edge 68 to the ceiling surface, there is very little, if any, dust which escapes from the open hopper top, as the ceiling itself acts as a lid or barrier to prevent such escape. Of course, additional peripheral, flexible seals (not shown) can be used around the edge 68, if desired, to completely or partially enclose the gaps between the ceiling and the upper hopper edge. Also, a negative draft could be applied inside the hopper 28 to draw-in ambient air around the upper edge 68 to further prevent dust emissions. In such an embodiment, an exhaust fan (not shown) could be placed on the side of the hopper to draw the necessary influx of the air therein.

What is claimed is:

1. A device for removing a layer of asbestos or like material from a ceiling comprising, extensible hoist means including a lower frame and an upper frame, adapted for travel beneath a ceiling surface;

hopper means mounted on the upper frame of the hoist means, said hopper means adapted to be raised by said hoist means in close proximity to said ceiling, and said hopper having an open top portion and an outlet orifice formed in a bottom portion thereof;

cutting means at the open top of the hopper means adapted to engage and remove said asbestos layer or the like from said ceiling, wherein the cutting means includes a pair of spaced apart augers, each having helically wound cutting surfaces formed thereon and extending across the open top of the hopper means; and collection means mounted on said hoist means and communicating with the outlet orifice of the hopper means adapted to receive the removed asbestos or like material therein.

2. The device of claim 1 including motorized drive means associated with the lower frame means for moving the hoist means along a floor surface beneath said ceiling.

3. The device of claim 2 including control means associated with said drive means for regulating the speed of said drive means whereby the rate of travel of said hoist means along said floor is controlled.

4. The device of claim 1 including spring means operably positioned between the upper frame and said hopper means to force said cutting means against the ceiling surface whereby said cutting means is adapted to remain in contact with said ceiling surface in the event a variation in ceiling height should occur.

5. The device of claim 4 including a pair of guide wheels upwardly extending from the top of the hopper means and spaced from said cutting means adapted to rollably engage said ceiling and maintain a substantially parallel orientation between said ceiling surface and a plane defined by the open top of the hopper means.

6. The device of claim 1 wherein the said pair of augers are positioned such that a helix orientation of each auger is opposite from that of an adjacent auger.

7. The device of claim 6 including roller brush means mounted on the open top of said hopper spaced in a rearward direction from said augers.

8. A device for removing a layer of asbestos or like material from a ceiling comprising:

extensible hoist means including a lower frame portion having front and rear sets of wheels thereon adapted to travel on a floor beneath said ceiling, said hoist means further including an upper frame portion;

drive means associated with the lower frame to motivate said hoist means on said floor;

hopper means having an open top, tapering sidewalls and an outlet orifice formed in a bottom portion thereof, and means for mounting said hopper to the upper frame portion of the hoist means including spring means to exert an upward force on said hopper means, said hopper means adapted to be raised by said extensible hoist means to an operable position in close proximity to the ceiling;

at least one auger cutter mounted across the open top of said hopper means, said auger cutter having a helically wound cutting surface extending above the open top of said hopper to engage the asbestos or like surface;

a motor for turning said auger cutter; and collection means mounted on said lower frame including a conduit communicating with said hopper outlet orifice to receive removed asbestos therein.

9. The device of claim 8 which has two auger cutters of oppositely oriented helices and further includes roller brush means positioned on the open top of the hopper in a rearward position, spaced from said auger cutters.

10. The device of claim 8 wherein the collection means includes a removable collection drum, having a sealing lid and further includes a flexible conduit secured at a first end to said lid and at a second end to said hopper outlet orifice.

* * * * *